US007942860B2

(12) United States Patent
Horppu

(10) Patent No.: US 7,942,860 B2
(45) Date of Patent: May 17, 2011

(54) PIERCING MEMBER PROTECTION DEVICE

(75) Inventor: Petri Horppu, Gothenburg (SE)

(73) Assignee: Carmel Pharma AB, Gothenburg (SE)

( * ) Notice: Subject to any disclaimer, the term of this patent is extended or adjusted under 35 U.S.C. 154(b) by 933 days.

(21) Appl. No.: 11/687,043

(22) Filed: Mar. 16, 2007

(65) Prior Publication Data

US 2008/0223484 A1 Sep. 18, 2008

(51) Int. Cl.
*B65B 3/04* (2006.01)

(52) U.S. Cl. ..... 604/411; 604/414; 141/2; 141/21; 141/379; 141/384

(58) Field of Classification Search ..... 141/18, 141/21–22, 329–330, 379, 384; 604/411, 604/414

See application file for complete search history.

(56) References Cited

U.S. PATENT DOCUMENTS

| | | | |
|---|---|---|---|
| 1,844,342 | A | 2/1932 | Berman |
| 2,010,417 | A | 8/1935 | Schwab |
| 2,697,438 | A | 12/1954 | Hickey |
| 2,717,599 | A | 9/1955 | Huber |
| 3,064,651 | A | 11/1962 | Henderson |
| 3,071,135 | A | 1/1963 | Baldwin et al. |
| 3,308,822 | A | 3/1967 | DeLuca |
| 3,316,908 | A | 5/1967 | Burke |
| 3,340,671 | A | 9/1967 | Loo |
| 3,390,677 | A | 7/1968 | Razimbaud |
| 3,448,740 | A | 6/1969 | Figge |
| 3,542,240 | A | 11/1970 | Solowey |
| 3,783,895 | A | 1/1974 | Weichselbaum |
| 3,788,320 | A | 1/1974 | Dye |

(Continued)

FOREIGN PATENT DOCUMENTS

AU 200112863 5/2003

(Continued)

OTHER PUBLICATIONS

Taiwan Search Report for Taiwan Patent Application 092106323 dated Mar. 21, 2003 (4 pages).

(Continued)

*Primary Examiner* — Gregory L Huson
*Assistant Examiner* — Nicolas A Arnett
(74) *Attorney, Agent, or Firm* — Fish & Richardson P.C.

(57) ABSTRACT

The invention concerns a piercing member protection device, a kit of a piercing member protection device, a first and second fluid container and a method a method for transferring a fluid between a first and a second container using a piercing member protection device. The piercing member protection device comprises a protection chamber to protect at least the tip of a piercing member. The piercing member protection device further comprises a first and a second member arranged to each other. The first member is further arranged to slide with respect to the second member between a secured position, in which at least the tip of the piercing member is enclosed within the protection chamber so as to prevent the tip of the piercing member from exposure and an unsecured position, in which the tip of the piercing member is arranged outside the protection chamber wherein the first member is arranged to turn with respect to the second member between a locked position and an unlocked position so that when the first member is in the locked position the first member is substantially unable to slide along the longitudinal axis A and when the first member is in the unlocked position the first member is enabled to slide along the longitudinal axis A.

20 Claims, 7 Drawing Sheets

U.S. PATENT DOCUMENTS 3,822,700 A 7/1974 Pennington
3,938,520 A 2/1976 Scislowicz et al.
3,976,073 A 8/1976 Quick et al.
4,096,860 A 6/1978 McLaughlin
4,296,786 A 10/1981 Brignola
D270,568 S 9/1983 Armstrong
4,490,139 A 12/1984 Huizenga et al.
4,516,967 A 5/1985 Kopfer
4,564,054 A * 1/1986 Gustavsson ..... 141/329
4,573,967 A 3/1986 Hargrove et al.
4,576,211 A * 3/1986 Valentini et al. ..... 141/329
4,581,016 A 4/1986 Gettig
4,582,223 A 4/1986 Kobe
4,588,403 A 5/1986 Weiss et al.
4,600,040 A 7/1986 Naslund
4,623,343 A 11/1986 Thompson
4,629,455 A 12/1986 Kanno
4,632,673 A 12/1986 Tiitola et al.
4,636,204 A 1/1987 Christopherson et al.
4,673,400 A 6/1987 Martin
4,673,404 A 6/1987 Gustavsson
4,737,150 A 4/1988 Baeumle et al.
4,752,287 A 6/1988 Kurtz et al.
4,759,756 A 7/1988 Forman et al.
4,768,568 A 9/1988 Fournier et al.
4,792,329 A 12/1988 Schreuder
4,804,015 A 2/1989 Albinsson
4,822,340 A 4/1989 Kamstra
4,826,492 A 5/1989 Magasi
4,834,717 A 5/1989 Haber et al.
4,842,585 A 6/1989 Witt
4,850,978 A * 7/1989 Dudar et al. ..... 604/263
4,864,717 A 9/1989 Baus, Jr.
4,872,494 A 10/1989 Coccia
4,878,897 A 11/1989 Katzin
4,889,529 A 12/1989 Haindl
4,898,209 A 2/1990 Zbed
4,909,290 A 3/1990 Coccia
4,932,937 A 6/1990 Gustavsson et al.
4,944,736 A 7/1990 Holtz
4,964,855 A 10/1990 Todd et al.
4,982,769 A 1/1991 Fournier et al.
4,994,048 A 2/1991 Metzger
4,997,083 A 3/1991 Loretti et al.
5,017,186 A 5/1991 Arnold
5,041,105 A 8/1991 D'Alo et al.
5,061,264 A 10/1991 Scarrow
5,071,413 A 12/1991 Utterberg
5,122,116 A 6/1992 Kriesel et al.
5,122,123 A 6/1992 Vaillancourt
5,137,524 A 8/1992 Lynn et al.
5,158,554 A 10/1992 Jepson et al.
5,176,673 A 1/1993 Marrucchi
5,199,947 A 4/1993 Lopez et al.
5,201,725 A 4/1993 Kling
5,207,658 A 5/1993 Rosen et al.
5,232,109 A 8/1993 Tirrell et al.
5,254,097 A 10/1993 Schock et al.
5,279,576 A 1/1994 Loo et al.
5,279,583 A 1/1994 Shober et al.
5,279,605 A 1/1994 Karrasch et al.
5,308,347 A 5/1994 Sunago et al.
5,312,366 A 5/1994 Vaillancourt
5,328,480 A 7/1994 Melker et al.
5,334,163 A 8/1994 Sinnett
5,356,406 A 10/1994 Schraga
5,385,545 A 1/1995 Kriesel et al.
5,385,547 A 1/1995 Wong et al.
5,389,085 A 2/1995 D'Alessio et al.
5,405,326 A 4/1995 Haber et al.
5,445,630 A 8/1995 Richmond
5,447,501 A 9/1995 Karlsson et al.
5,456,675 A 10/1995 Wolbring et al.
5,470,522 A 11/1995 Thome et al.
5,478,328 A 12/1995 Silverman et al.
5,478,337 A 12/1995 Okamoto et al.
5,492,531 A 2/1996 Post et al.
5,514,117 A 5/1996 Lynn
5,515,871 A 5/1996 Bittner et al.
5,536,259 A 7/1996 Utterberg
5,575,780 A 11/1996 Saito
5,593,028 A 1/1997 Haber et al.
5,613,954 A 3/1997 Nelson et al.
5,632,735 A 5/1997 Wyatt et al.
5,647,845 A 7/1997 Haber et al.
5,685,866 A 11/1997 Lopez
5,752,942 A 5/1998 Doyle et al.
5,766,147 A 6/1998 Sancoff et al.
5,766,211 A 6/1998 Wood et al.
5,782,872 A 7/1998 Muller
5,795,336 A 8/1998 Romano et al.
5,817,083 A 10/1998 Shemesh et al.
5,820,609 A 10/1998 Saito
5,827,262 A 10/1998 Neftel et al.
5,837,262 A 11/1998 Golubev et al.
5,875,931 A 3/1999 Py
5,879,345 A * 3/1999 Aneas ..... 604/411
5,897,526 A 4/1999 Vaillancourt
5,934,510 A 8/1999 Anderson
5,984,899 A 11/1999 D'Alessio et al.
6,063,068 A 5/2000 Fowles et al.
D427,308 S 6/2000 Zinger
6,070,623 A * 6/2000 Aneas ..... 141/329
6,071,270 A 6/2000 Fowles et al.
6,090,091 A 7/2000 Fowles et al.
6,113,068 A 9/2000 Ryan
6,113,583 A 9/2000 Fowles et al.
6,142,446 A 11/2000 Leinsing
6,146,362 A 11/2000 Turnbull et al.
6,209,738 B1 * 4/2001 Jansen et al. ..... 141/329
6,221,065 B1 4/2001 Davis
6,245,056 B1 6/2001 Walker et al.
D445,501 S 7/2001 Niedospial, Jr.
6,253,804 B1 7/2001 Safabash
6,258,078 B1 * 7/2001 Thilly ..... 604/411
6,387,074 B1 5/2002 Horppu et al.
6,453,956 B2 9/2002 Safabash
6,471,674 B1 10/2002 Emig et al.
6,517,523 B1 2/2003 Kaneko et al.
6,537,263 B1 3/2003 Aneas
6,571,837 B2 6/2003 Jansen et al.
6,591,876 B2 7/2003 Safabash
6,644,367 B1 11/2003 Savage et al.
6,685,692 B2 2/2004 Fathallah
6,715,520 B2 4/2004 Andreasson et al.
6,761,286 B2 7/2004 Py et al.
D495,416 S 8/2004 Dimeo et al.
6,786,244 B1 9/2004 Jones
D506,256 S 6/2005 Miyoshi et al.
6,960,194 B2 11/2005 Hommann et al.
7,000,806 B2 2/2006 Py et al.
7,080,672 B2 7/2006 Fournier et al.
7,297,140 B2 * 11/2007 Orlu et al. ..... 604/411
D570,477 S 6/2008 Gallogly et al.
D572,820 S 7/2008 Gallogly et al.
D577,438 S 9/2008 Gallogly et al.
D577,822 S 9/2008 Gallogly et al.
D582,033 S 12/2008 Baxter et al.
D605,755 S 12/2009 Baxter et al.
7,703,486 B2 4/2010 Costanzo
D616,984 S 6/2010 Gilboa
7,744,581 B2 6/2010 Wallen et al.
2001/0021825 A1 9/2001 Becker et al.
2001/0025671 A1 10/2001 Safabash
2002/0002352 A1 1/2002 Becker et al.
2002/0082586 A1 6/2002 Finley et al.
2002/0127150 A1 9/2002 Sasso
2002/0177819 A1 11/2002 Barker et al.
2003/0010717 A1 1/2003 Brugger et al.
2003/0070726 A1 4/2003 Andreasson et al.
2003/0106610 A1 6/2003 Roos et al.
2003/0107628 A1 6/2003 Fowles et al.
2003/0199846 A1 10/2003 Fowles et al.
2003/0233083 A1 12/2003 Houwaert et al.
2004/0116858 A1 6/2004 Heinz et al.
2004/0199139 A1 10/2004 Fowles et al.
2004/0215147 A1 10/2004 Wessman et al.

| | | | |
|---|---|---|---|
| 2005/0215977 | A1 | 9/2005 | Uschold |
| 2006/0025747 | A1 | 2/2006 | Sullivan et al. |
| 2006/0106360 | A1 | 5/2006 | Wong |
| 2006/0111667 | A1 | 5/2006 | Matsuura et al. |
| 2006/0157984 | A1 | 7/2006 | Rome et al. |
| 2006/0186045 | A1 | 8/2006 | Jensen et al. |
| 2007/0021725 | A1 | 1/2007 | Villette |
| 2007/0060841 | A1 | 3/2007 | Henshaw |
| 2007/0088313 | A1 | 4/2007 | Zinger et al. |
| 2007/0106244 | A1 | 5/2007 | Mosler et al. |
| 2007/0179441 | A1 | 8/2007 | Chevallier |
| 2007/0270759 | A1 | 11/2007 | Pessin |
| 2007/0270778 | A9 | 11/2007 | Zinger et al. |
| 2008/0045919 | A1 | 2/2008 | Jakob et al. |
| 2008/0103453 | A1 | 5/2008 | Liversidge |
| 2008/0103485 | A1 | 5/2008 | Kruger |
| 2008/0172039 | A1 | 7/2008 | Raines |
| 2008/0223484 | A1 | 9/2008 | Horppu |
| 2008/0287920 | A1 | 11/2008 | Fangrow et al. |
| 2008/0312634 | A1 | 12/2008 | Helmerson et al. |
| 2009/0254042 | A1 | 10/2009 | Gratwohl et al. |
| 2010/0137827 | A1 | 6/2010 | Warren et al. |
| 2010/0204671 | A1 | 8/2010 | Kraushaar et al. |
| 2010/0243099 | A1 | 9/2010 | Yodfat |

FOREIGN PATENT DOCUMENTS

| | | |
|---|---|---|
| DE | 2005519 | 10/1979 |
| EP | 0255025 | 2/1988 |
| EP | 0259582 | 3/1988 |
| EP | 0285424 | 10/1988 |
| EP | 0311787 | 4/1989 |
| EP | 0376629 | 7/1990 |
| EP | 0803267 | 10/1997 |
| EP | 0819442 | 1/1998 |
| EP | 0995453 | 4/2000 |
| EP | 1060730 | 12/2000 |
| EP | 1484073 | 12/2004 |
| EP | 1731128 | 12/2006 |
| FR | 2757405 | 6/1998 |
| FR | 2780878 | 1/2000 |
| GB | 1579065 | 11/1980 |
| JP | 49-12690 | 5/1972 |
| JP | 288664 | 7/1990 |
| JP | 3030963 | 8/1996 |
| JP | 2000167022 | 6/2000 |
| JP | 2001505092 | 4/2001 |
| JP | 2001293085 | 10/2001 |
| TW | 482670 | 4/2002 |
| WO | WO 84/04672 | 12/1984 |
| WO | WO 84/04673 | 12/1984 |
| WO | WO 9003536 | 4/1990 |
| WO | WO 98/19724 | 5/1998 |
| WO | WO 99/27886 | 6/1999 |
| WO | WO 99/62578 | 12/1999 |
| WO | WO 00/05292 | 2/2000 |
| WO | WO 00/35517 | 6/2000 |
| WO | WO 01/80928 | 11/2001 |
| WO | WO 02/02048 | 1/2002 |
| WO | WO 02/11794 | 2/2002 |
| WO | WO 02/064077 | 8/2002 |
| WO | WO 02/076540 | 10/2002 |
| WO | WO 2005/074860 | 8/2005 |
| WO | WO 2006/083333 | 8/2006 |
| WO | WO 2006082350 | 8/2006 |
| WO | WO 2006/138184 | 12/2006 |
| WO | WO 2008/115102 | 9/2008 |

OTHER PUBLICATIONS

Japan Application No. 2003-583539, Official Action dated May 1, 2009 (3 pages).

Japan Application No. 2003-577789, Official Action dated Feb. 24, 2009 (4 pages).

International Search Report, PCT/EP2008/067535 dated Oct. 13, 2009 (3 pages).

International Search Report, PCT/EP2008/067522 dated Aug. 12, 2009. (2 pages).

* cited by examiner

PIERCING MEMBER PROTECTION DEVICE

TECHNICAL FIELD

The invention concerns a piercing member protection device and more specifically a piercing member protection device for transferring a fluid between a first and a second container. The invention also concerns a kit and a method for transferring a fluid between a first and a second container using a piercing member protection device.

BACKGROUND OF THE INVENTION

A serious problem in connection with drug preparation, drug administration and other similar handling is the risk that medical and pharmacological staff are exposed to drugs or solvents which might escape into the ambient air. This problem is particularly serious when cytotoxins, antiviral drugs, antibiotics and radiopharmaceuticals are concerned. Other hazardous areas may be sampling taking such as samples concerning virus infections or the like.

For this reason, there has been a need of safer systems for handling and administrating drugs and other medical substances.

Accordingly, U.S. Pat. No. 4,564,054 (Gustavsson) discloses a fluid transfer device for transferring a substance from one vessel to another vessel while avoiding leakage of liquid and gas contaminants. The disclosed device comprises a first member designed as a hollow sleeve and having a piercing member provided with a passageway. The piercing member is attached to the first member which has a first barrier member at one end just opposite the tip of the piercing member. Thereby, the piercing member can be passed and retracted through the first barrier member which seals one end of the first member. The fluid transfer device further comprises a second member which is attached to or attachable to one of the vessels or to means arranged to communicate therewith. The second member has a second barrier member, and mating connection means arranged on the first and second members for providing a releasable locking of the members with respect to each other. The barrier members are liquid and gas-proof sealing members which seal tightly after penetration and retraction of the piercing member and prevent leakage of liquid as well as gas contaminants. In the connected position of the first and second members, the barrier members are located in such a way with respect to each other that the piercing member can be passed therethrough.

Similarly, U.S. Pat. No. 4,576,211 discloses a fluid transfer device to which one end a syringe may be connected and to the other end of a mouth or opening of a bottle containing a drug or medicine may be connected. The device comprises a closed chamber having enclosed therein a needle which is in connection with the syringe. Connection members are provided by means of which the mouth or opening of the bottle is steadily connected to the device and means enabling the needle to perforate a seal plug and a small rubber plug mounted on the bottle only when the device is blocked onto the bottle so that in any case it cannot be disconnected therefrom. The device can be disconnected from the bottle only after the needle has been caused to reenter the closed chamber, so as to prevent any possible dripping of the liquid outside of the device. In order to enabling the needle to perforate the seal plug, i.e. to move forward, a rotational movement is required. The connection mechanism uses teeth members which slide in helicoidally elongated slits. The device described in U.S. Pat. No. 4,576,211 is therefore not very user friendly since protection gloves may get caught between the teeth members and the slits during this rotational movement.

When performing infusion, it is often necessary to inject a drug or other medical substance into the infusion fluid inside an infusion bag or other infusion fluid container. This is often done by means of penetrating a septum or other fluid barrier of an injection port on the infusion bag or on the infusion fluid line with a needle of a syringe filled with the medical fluid in question. However, even before this it may be necessary to transfer the medical fluid from a vial to a syringe and then from the syringe to a secondary container. In each of these moments staff may be exposed to the medical fluid by means of contamination. Such contamination may be vaporized medical fluid or aerosol in the air. The contaminations may contaminate the staff trough their lungs or vaporized medical fluid or aerosol in the air which condensates on the skin to thereafter penetrate the skin of the staff. Some medicaments are even known to penetrate protection gloves and thereby contaminate the staff.

Exposure of contaminations like this may on a long term basis give rise to alarmingly high concentrations of medicaments in the blood of the just mentioned staff. It has been understood that due to the many transferring steps between e.g. vials, syringes, infusion systems etc. the risk for contamination during the actual insertion and retraction of a needle from e.g. a vial has been underestimated and therefore not properly solved.

SUMMARY OF THE INVENTION

It is therefore an object of the present invention to provide a piercing member protection device which minimizes or completely eliminates the risk of exposure of the piercing member and thereby also reduce the risk for exposure of contaminants during a fluid transfer e.g. between two fluid containers.

This object is at least partly solved by a piercing member protection device comprising a longitudinal axis A, wherein said piercing member protection device comprises a protection chamber to protect at least the tip of a piercing member. The piercing member protection device further comprises a first and a second member arranged to each other, the first member having a first and a second end and an inner and outer surface, and the second member having a first and a second end and an inner and outer surface. Additionally the first member is arranged to slide with respect to the second member between a secured position, in which at least the tip of the piercing member is enclosed within the protection chamber so as to prevent the tip of the piercing member from exposure, and an unsecured position, in which the tip of the piercing member is arranged outside the protection chamber. The first member is further arranged to turn with respect to the second member between a locked position and an unlocked position so that when the first member is in the locked position the first member is substantially unable to slide along the longitudinal axis A and when the first member is in the unlocked position the first member is enabled to slide along the longitudinal axis.

The first member is preferably turned without substantially moving the first member along the longitudinal axis A. This eliminates the risk of exposure of a piercing member when accidentally turning the first member.

The present invention provides for a safe handling during transfer of fluids from a first container to a second container. The risk of being pierced, scratched or torn by the piercing member is minimised when using the present invention.

The piercing member protection device can further be arranged to comprise a third member arranged to said second member, the third member has a first and a second end and an inner and outer surface, wherein the first end of said third member comprises connection means for connecting to a first fluid container. The connection means enables a firm connection between the piercing member protection device and a first fluid container.

The second member may further be arranged to at least partly enclose the outer surface of the third member, preferably so that the first and the second end of said second member are arranged longitudinally inwards of the first and second end of the third member. The embodiments enable flexible adaptations and easy manufacture of the device.

A piercing member such as a needle like tube, preferably a needle, is preferably arranged to the first member along the longitudinal axis A. The piercing member can however also be arranged on a second fluid container intended to be attached to the second end of the first member. Such a piercing member may preferably be used together with flexible barriers membranes covering at least the first end of the third member or both the first and second end of the third member. The protective chamber is effectively sealed with such a configuration preventing contaminants from escaping.

In another embodiment of the present invention the first member is arranged with stabilization means in order to stabilise a piercing member e.g. during insertion into the first container.

The third member may further be adapted to be turned with respect to the second member by means of the first member. Such a configuration has the advantage of providing a user friendly configuration which easily can be connected to a first fluid container. The first member may for instance at least partly be made of a flexible material which may be compressed against the third member in order to hold the third member during turning of the first member. Alternative such means can comprise a protrusion and a groove. In an advantageous embodiment of the present invention, the means of a protrusion and a groove comprises an end protrusion protruding out from the plane of the outer surface of the third member at the second end of the third member, and that the end protrusion is arranged to be in working cooperation with a longitudinal groove arranged on the inner surface of the first member.

In a further embodiment of the present invention the locked position and the unlocked position are obtained by means of a fixation protrusion and a substantially L-shaped groove, arranged on the first member and said second member. The fixation protrusion preferably protrudes out from the plane of the outer surface of the second member, and while the L-shaped groove is arranged on the inner surface of the first member. In such case the L-shaped groove preferably extends along the longitudinal axis A and transverse to the longitudinal axis A. It is noted that the substantially L-shaped groove could be made with slightly different form but still having a locked and an unlocked position, such as an L-shaped groove with but an angle of less than 90°.

In another embodiment of the present invention the first end of said second member comprises engagement means wherein said engagement means is arranged to engage with said first container so as to prevent said second member from turning in a clock-wise or anti-clock wise direction. The embodiment enables the user to turn the device into an unlocked position with one hand and thereby enabling the first member to be moved to its unsecured position to provide fluid communication between the first and the second container.

The engagement means prevents the second member from turning which enables the relative turning of the third member in a more secure and easily manner. The engagement means may for instance comprise an engagement protrusion, extending along the longitudinal axis A, and arranged at the first end of the second member. As an alternative, the engagement protrusion may extend out of the plane of the outer surface of the second member. A combination of the both embodiments mentioned above is also possible. Such engagement means as mentioned above, alone or in combination, will preferably have a corresponding engagement means on the first container intended to be attached to the first end of the third member.

In another advantageous embodiment of the present invention the second member comprises a flange arranged in the proximity of the first end of said second member, the flange extending from the inner surface of the second member in a direction towards the longitudinal axis A. The flange is further arranged to engage a groove arranged on the outer surface of the third member wherein the flange and the groove are arranged transverse to the longitudinal axis A so that the second and third member are substantially fixed from movement along the longitudinal axis A with respect to each other. The described embodiment enables the third member to turn with respect to the second member while at the same time prevent the second member from movement along the longitudinal axis A.

A further flange may be arranged on the second member extending from the outer surface of the second member in a direction away from the longitudinal axis A. The flange is preferably arranged in the proximity of the first end of the second member, wherein the flange acts as stopping means to stop the first member from sliding beyond the flange and/or as stabilization means to the above mentioned engagement means.

The piercing member protection device according to the present invention may optionally be used in various different fields of technology such as in food manufacturing or in the medical field. Preferably the piercing member protection device is a medical piercing member protection device. Such medicines may e.g. be cytotoxins, antiviral drugs, antibiotics and radiopharmaceuticals or the like.

The first member of the piercing member protection device according to the present invention has preferably a cylindrical inside, but more preferably, to simplify the manufacturing, it is a cylinder member. Likewise, the second and third members are preferably cylinder members.

The present invention further comprises a kit comprising a first fluid container, a second fluid container and a piercing member protection device according to claim 1 to protect a piercing member used for transferring fluid between the first container and the second container.

The present invention further involves a method for transferring fluid between a first container and a second container using a piercing member protection device according to claim 1 to protect a piercing member used for transferring fluid between the first container and the second container. The method comprises the steps of:

connecting the first and the second fluid container to the piercing member protection device;

turning the first member with respect to the second member from a locked position to an unlocked position, wherein when the second member is in the lock position the first member is substantially unable to slide along the longitudinal axis A and when the second member is in the unlocked position the first member is able to slide along the longitudinal axis A; and moving the first member along the longitudinal axis A to the unsecured position and thereby exposing the piercing member outside the protection chamber so that fluid communication between the first container and the second container is provided.

It is well within the boundaries of the present invention that the kit and the method for transferring fluid may be combined with any of the piercing member protection device embodiments described herein, for instance, but not limited to, in any of the embodiments as described in any of the depending claims.

Definitions

With the term "piercing member" it is meant a hollow object, such as a needle like tube or a needle, which may pierce a membrane or similar in order to retract or infuse a gas fluid or a liquid fluid (i.e. a fluid). The mentioned membrane may be the skin of a patient or a flexible barrier member on e.g. a vial or on an infusion bag or the like.

With the term "medical piercing member protection device" is meant a piercing member protection device which protects piercing members used directly or indirectly in the medical field of technology e.g. in hospital environments or hospital like environments, pharmaceutical industry, home care etc. Examples of such medical devices are needles, needle like tubes, syringes, infusion bags, medical fluid transfer devices, medical vials, medical fluid containers, medical sampling containers or the like.

BRIEF DESCRIPTION OF THE DRAWINGS

In the following the present invention will be described in greater detail with reference with to the attached drawings, in which.

DETAILED DESCRIPTION OF PREFERRED EMBODIMENTS

Figure 1:
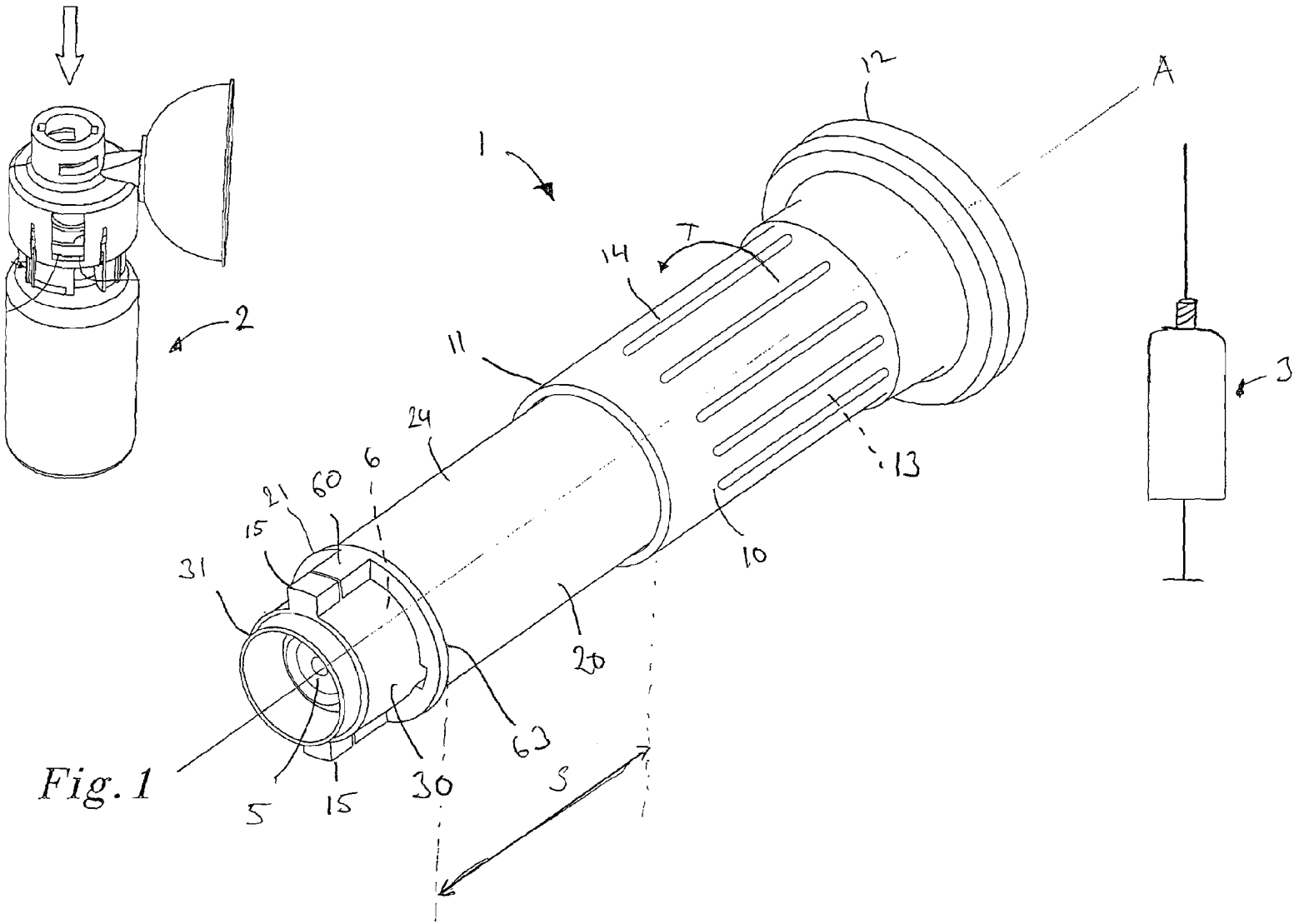
FIG. 1 is a schematic illustration of the piercing member protection device as see in perspective together with a first and a second fluid container.

FIG. 1 illustrates a piercing member protection device according to the present invention, more specifically FIG. 1 shows a piercing member protection device 1, having a longitudinal axis A, comprising a first member 10, a second member 20 and a third member 30. The first member 10 has a first end 11 and a second end 12 and an inner and an outer surface 13, 14. The second end 12 of the first member 10 comprises means for attaching the first member to a second container 3. The second member 20 at least partly encompasses the third member 30. The first member 10 at least partly encompasses the second and third member 20, 30. The third member 30 has a first end 31 comprising connection means 15 for connecting to a first container 2 (as indicated by an arrow). The first end 31 of the third member 30 also comprises a guiding port 5 through which a piercing member is to be guided trough to the first container 2. The guiding port 5 is preferably funnel shaped in the inside in order to easier facilitate the guiding of the piercing member. At least the tip of the piercing member is arranged in a protection chamber 6, defined in this embodiment of the present invention by the boundaries of the third member. The piercing member (not shown) may either be arranged, as described below on the first member 10, or as an alternative it may be arranged directly on the second container 3 (as illustrated in FIG. 1).

The first, second and third member 10, 20, 30 can be made by any suitable material but is preferably made by a thermoplastic material such as polypropylene, polyethylene, polyurethane, polystyrene, polyoxymethylene, acrylonitrile-butadienestyrene copolymer (ABS), polyethylene terephthalate or mixtures thereof. The first, second and third member 10, 20, 30 can be made of different material or of the same material. In one embodiment the third member 30 is made of a transparent material in order to allowing the user of the device to easily see if proper insertion of the piercing member is achieved. A suitable material should be somewhat flexible to allow for the second member 20 to be threaded onto the third member 30 without major difficulties but rigid enough to provide enough protection for the needle like tube arranged inside the third member 30 when such is present.

Figure 5:
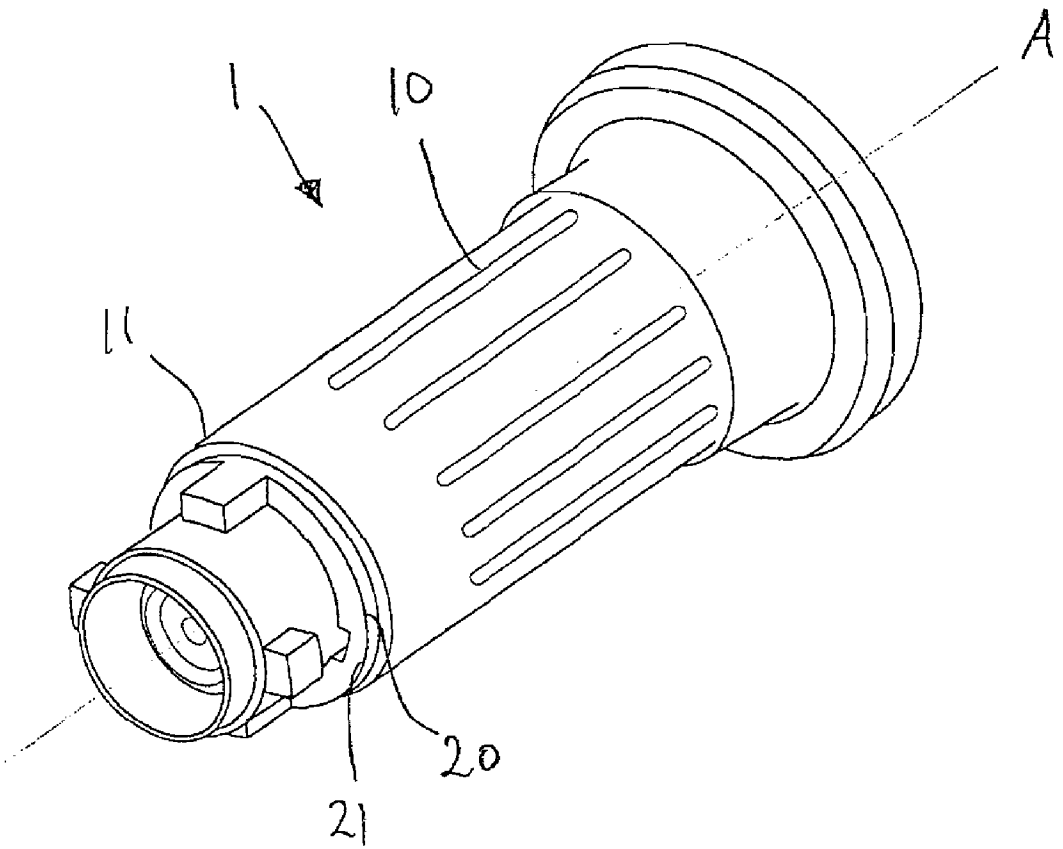
FIG. 5 is a schematic illustration of the piercing member protection device as see in perspective after the first member has been moved to the unsecured position.

The first member 10 is arranged to slide along the longitudinal axis A from a secured position (as shown in FIG. 1) to an unsecured position (as shown in FIG. 5). When the first member 10 is in its secured position at least the tip of said piercing member is enclosed within the protection chamber 6 so as to prevent the tip of the piercing member from exposure. In the unsecured position, the tip of the piercing member is arranged outside the protection chamber.

It is noted that an unsecured position is achieved somewhere along the longitudinal axis A dependent on the length of the piercing member used to transfer the fluid. Preferably, the first member 10 is moved a minimum length of 10-30% of the total length (i.e. the total length being the maximum length possible to move the first member 10) before the piercing member protection device is in its unsecured position. The total length is illustrated in FIG. 1 with a slide arrow S. The first member 10 may further be turned with respect to the second member 20 from a locked position to an unlocked position, as illustrated in FIG. 1 by the turning arrow T. When the piercing member protection device 1 is in its unsecured position, a fluid communication is provided between the first and the second container when these are connected, while in its secured position, no fluid communication is provided between the first and the second container.

Engagement means 60 is arranged on the first end 21 of the second member 20 in order to engage a first container in order to prevent the second member 20 from turning during connection. The engagement means 60 are in the form of a longitudinal protrusion extending in the direction of the longitudinal axis A which engages the first container in a corresponding groove on the first container. It is however well within the boundaries of the present invention that the engagement means 60 may be constituted by a groove on the second member 20 which engages a corresponding protrusion on the first container 2. As an alternative, the second member 20 may be held in place by the user during turning, in which case no engagement means are necessary, this embodiment is however less preferred.

Advantageously, the first end 31 of the third member 30 is equipped with a flexible barrier member. In may further be designed and arranged for creating a double-membrane sealing when the connection means 15 is connected to the first container 2. In such case the first container 2 may be e.g. a flexible infusion bag of an infusion system, an infusion fluid line of the mentioned infusion system or a separate spike device exhibiting a flexible barrier member. Preferably, the first end 31 of the third member 30 is designed and arranged for all these cases. Double membrane bayonet couplings are known per se from the U.S. Pat. No. 4,564,054 and will hereafter not be described in greater detail. As a measure of safety, a second flexible barrier member may be provided at the second end 32 of the third member 30. The flexible barrier members are liquid and gas-proof sealing members which seal tightly after penetration and retraction of the piercing member and prevent leakage of liquid as well as gas contaminants.

In cases where the piercing member is arranged on the first member 10, it preferably stretches through the second flexible barrier member so its tip is arranged inside the third member 30.

The second and third member 20, 30 are substantially fixed from movement along the longitudinal axis A with respect to each other. A flange extending from the inner surface of the second member in a direction towards the longitudinal axis A and the centre of the second member is preferably arranged in the proximity of the first end 21 of said second member 20. The flange may further be arranged to engage a groove (not shown) arranged on the outer surface 34 of the third member 30 wherein the flange and the groove are arranged transverse to the longitudinal axis A so that the second and third member 20, 30 are substantially fixed from movement along the longitudinal axis A with respect to each other. The described embodiment enables the third member to turn with respect to the second member while at the same time prevent the second member from movement along the longitudinal axis A. A further flange 63 may be arranged on the second member 20 extending from the outer surface 24 of the second member 20 in a direction away from the centre of the second member 20. The flange is preferably arranged in the proximity of the first end 21 of the second member 20, wherein the flange acts as stopping means to stop the first member 10 from sliding beyond the flange.

Figure 2:
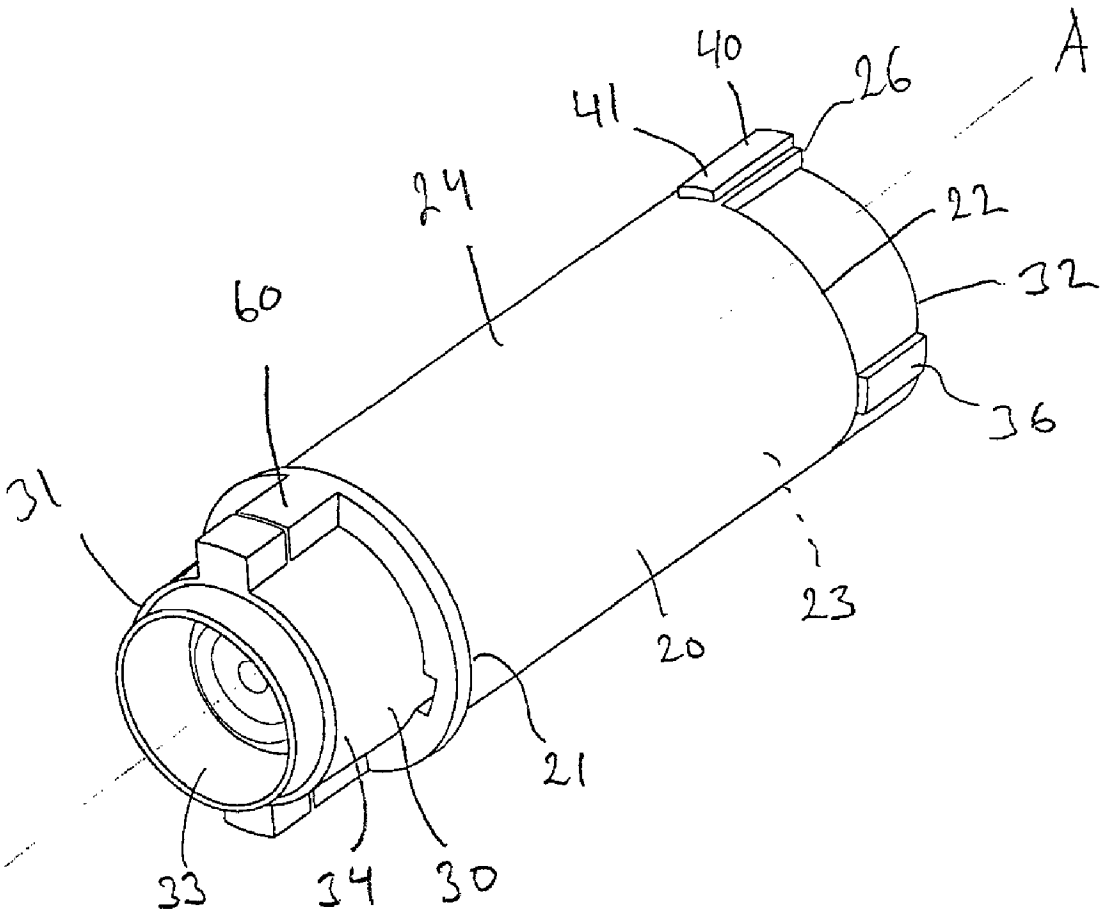
FIG. 2 is a schematic illustration of a part of the piercing member protection device seen in perspective.

In FIG. 2 only parts of the piercing member protection device is shown in order to explain the features and the function of the device in greater detail. The third member 30 has a first end 31 opposite a second end 32 and an inner and an outer surface 33, 34. The second member 20 has a first end 21 opposite a second end 22 and an inner and an outer surface 23, 24. The second member 20 is arranged to encompass the third member 30 so that the first and the second end 21, 22 of the second member 20 is positioned between the first and the second end 31, 32 of the third member 30. The inner surface 23 of the second member 20 is in this embodiment further arranged directly adjacent the outer surface 34 of the third member. A first part of fixation means 40 is arranged at the proximity of the second end 22 of the second member 20 which is intended to interact in working cooperation with a second part of fixation means 40 on the first member 10 (not shown in FIG. 2). The main object of the fixation means 40 is to prevent the first member 10 from turning with respect to the second member 20 while at the same time allow the first member to slide along the longitudinal axis A (as earlier illustrated in FIG. 1) after the first part of fixation means 40 has engaged the second part of fixation means 40.

As further illustrated in FIG. 2 the locked position and the unlocked position are obtained by means of fixation means 40 and more specifically a fixation protrusion 41 arranged on the second member 20 and a substantially L-shaped groove arranged on the first member 10 (not shown in FIG. 2). The fixation protrusion 41 preferably protrudes out from the plane of the outer surface of the second member, while the L-shaped groove is preferably arranged on the inner surface 13 of the first member 10. In such a case the L-shaped groove preferably extends along the longitudinal axis A and transverse to the longitudinal axis A. The fixation protrusion 41 is thereby arranged to be in working cooperation with the L-shaped groove of the first member 10. It is of course well within the boundaries of the present invention that the just mentioned fixation protrusion 40 is arranged on the inner surface of the first member and that the L-shaped groove is arranged on the outer surface 23 of the second member 20. The main object of the fixation protrusion 41 is to prevent the first member 10 from turning with respect to the second member 20 after the fixation protrusion has entered that part of the L-shaped groove running parallel with the longitudinal axis A, while at the same time allow the first member 10 to slide along the longitudinal axis A (as earlier illustrated in FIG. 1).

In a preferred embodiment of the present invention, the engagement means 60 and the fixation means 40 interact. The engagement means 60 on the second member 20 engages the first container 2, which allows for the first and third member 10, 30 to be turned with respect to the second member 20 (since the second member 20 is held in place by the first container 2 via engagement means 60). During this turning, the fixation protrusion slides in the transversally oriented part of the L-shaped groove and the first member 10 is effectively prevented from being able to slide to the unsecured position. While when the fixation protrusion 41 has entered the part of the L-shaped groove running parallel with the longitudinal axis A (i.e. when the first member 10 is moved towards the unsecured position), the fixation protrusion 41 and the part of the L-shaped groove running parallel with the longitudinal axis A prevents the first member 10 from being able to turn with respect to the second member 20. This embodiment effectively prevents the release of the piercing member protection device from a first container 2 before the first member 10 has been retracted to its secured position. By this exposure of the tip of the piercing member is effectively prevented and accidents may be prevented.

The fixation protrusion 41 is in the illustrated embodiment arranged on a longitudinal protrusion which protrudes in a longitudinal direction from the second end 22 of the second member 20. The longitudinal protrusion 26 aligns with the second 32 end of the third member 30.

The third member 30 further comprises an end protrusion 36 protruding out from the plane of said outer surface 34 of the third member 30 at the second end 32 of said third member 30. The end protrusion 36 is arranged to be in working cooperation with a longitudinal groove arranged on the inner surface of the first member 10 (not shown in FIG. 2). When the end protrusion 36 on the third member 30 and the longitudinal protrusion 26 on the second member 20 are separated by a distance, as illustrated in FIG. 2, the second member is in its locked position due to the displacement of the fixation protrusion 41 of the second member 20 and the corresponding part of the L-shaped groove running parallel with the longitudinal axis A on the inner surface 13 of the first member 10. In the illustrated embodiment of the present invention the mentioned distance corresponds to an approximately 90° turn of the second member 20 with respect to the third member 30. In alternative embodiments, the second member 20 may be turned more than 90° e.g. 110° or 130°, or less than 90° e.g. 70° or 50° with respect to the third member 30. An unlocked position is effectively achieved when the first member 10, and the third member 30, is turned with respect to the second member 10. This allows the fixation protrusion 41 of the second member 20 to align with, i.e. to get in position to slide into the part of the L-shaped groove running parallel with the longitudinal axis A. The first member 10 may subsequently be moved towards its unsecured position as described earlier.

Figure 3:
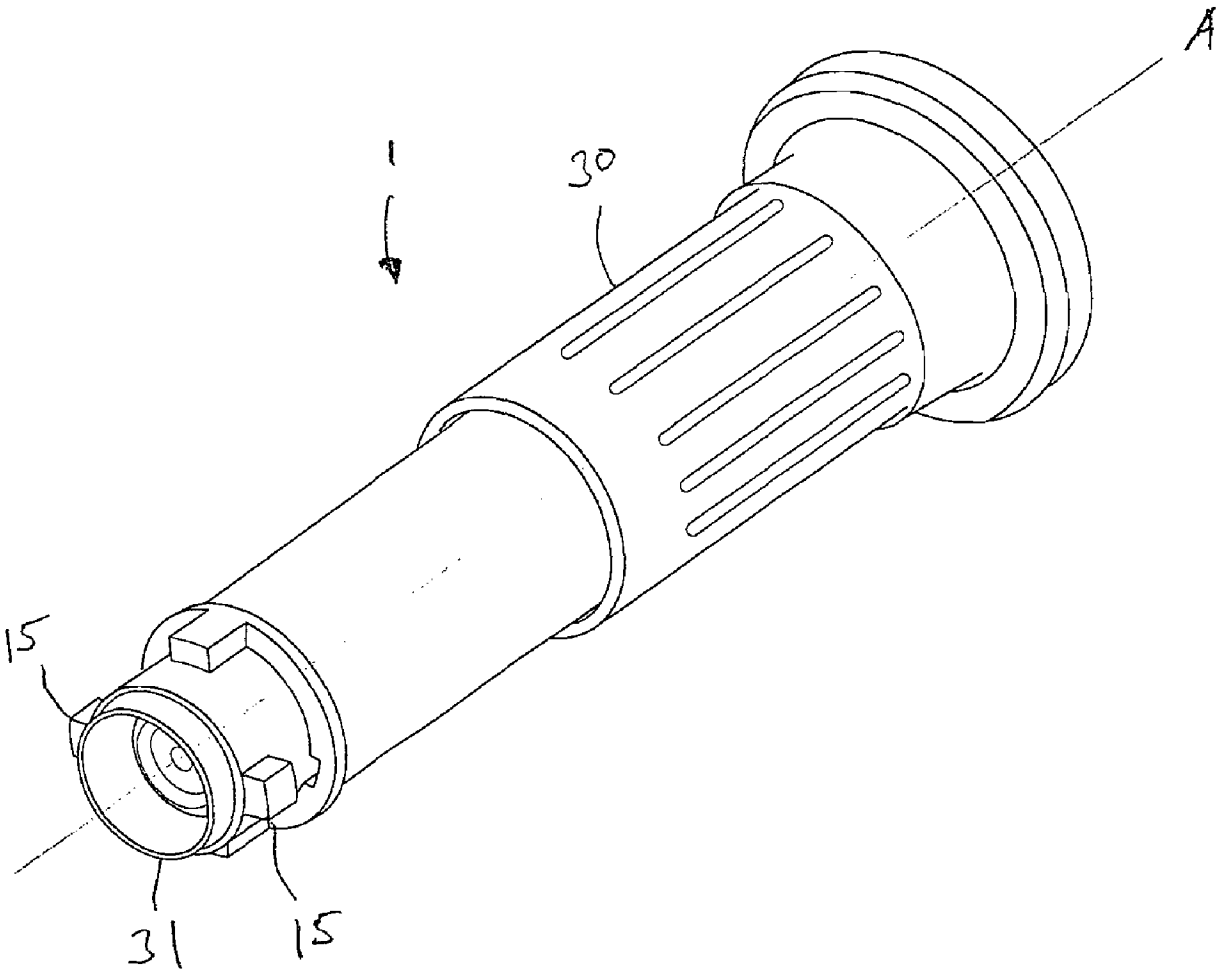
FIG. 3 is a schematic illustration of the piercing member protection device as see in perspective after the third member and the first member has been turned with respect to the second member.

FIG. 3 illustrates the piercing member protection device 1 after the first and the third member 10, 30 has been turned approximately 90° in an anti clock-wise direction with respect to the second member 20, however an alternative embodiment can of course likewise be turned in a clock-wise direction. The second member 20 is in FIG. 3 shown in its unlocked position so as to allow for the first member 10 to slide to the unsecured position of the piercing member protection device 1. The unsecured position is further illustrated in FIG. 5. It can further be noticed that the connection means 15 arranged in the proximity of the first end 31 of the third member 30 also has been turned 90° in an anti clock-wise direction so as to engage a connection means on a first container 2.

Figure 4:
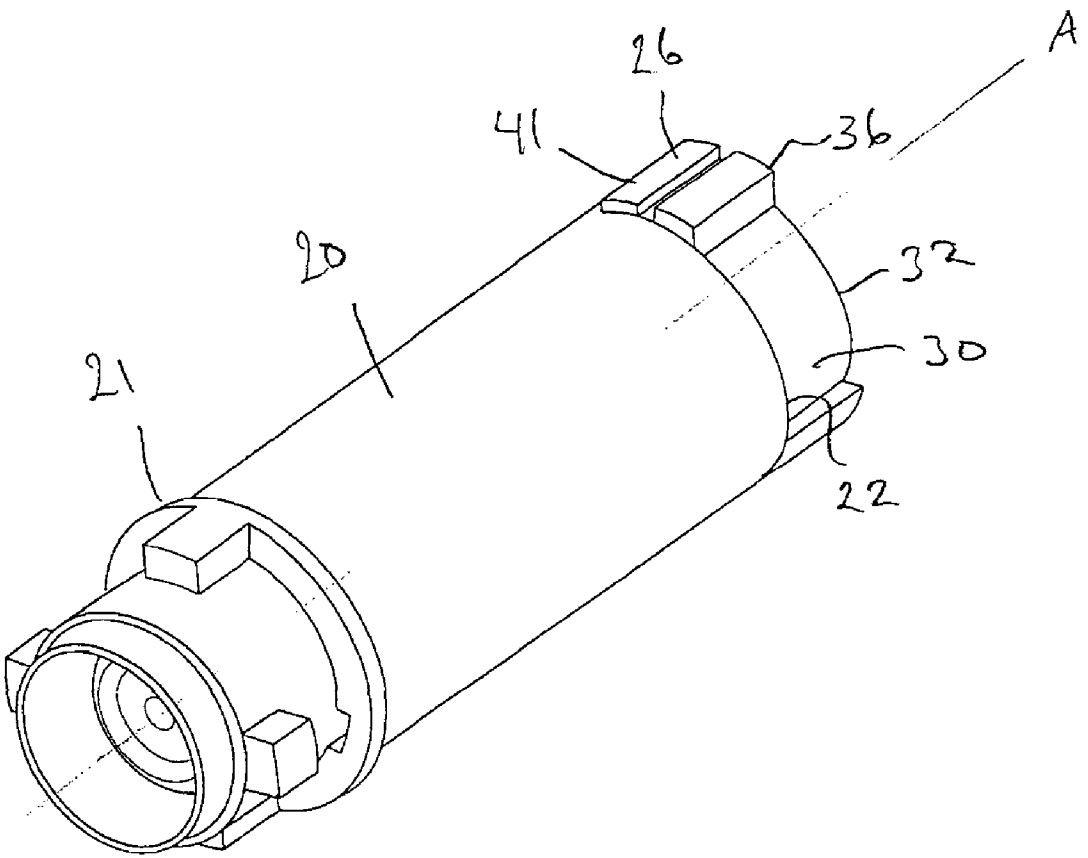
FIG. 4 is a schematic illustration of a part of the piercing member protection device seen in perspective after the third member and the first member has been turned with respect to the second member.

As is evident from FIG. 4 the fixation protrusion 41 at the second end 22 of the second member 20 and the end protrusion 36 at the second end 32 on the third member 30 are positioned adjacent each other so that the fixation protrusion 41 at the second end 22 of the second member 20 is aligned with the part of the L-shaped groove running parallel with the longitudinal axis A arranged on the inner surface 13 of the first member 10 (not shown in FIG. 4) so as to allow for the first member 10 to slide along the longitudinal axis A towards the first end 21 of the second member 20 and the unsecured position.

In FIG. 5 the first member 10 has been moved to its unsecured position. If the first member 10 had been arranged with a piercing member, or, where the second container is provided with a piercing member, the tip of the piercing member would have been exposed outside the protection chamber definer by the third member 30. Fluid communication may thereby be enabled between a first container and a second container when the piercing member protection device 1 is connected to two such containers. In the illustrated embodiment of the present invention the unsecured position is reached when the first end 11 of the first member 10 is in the proximity of the first end 21 of the second member 20. Once the first member 10 has been turned and has started its movement towards the first end 21 of the second member 20, the fixation protrusion 41 at the second end 22 of the second member 20 (see FIG. 4) enters the corresponding longitudinal groove on the inner surface of the first member 30. As soon as the fixation protrusion 41 at the second end 22 of the second member 20 has entered the part of the L-shaped groove running parallel with the longitudinal axis A on the inner surface 13 of the first member 10, the first member 10 is effectively prevented from being turned back in a clock-wise direction.

In order to disconnect the piercing member protection device 1, the first member 10 must be retracted to its secured position before it may be turned in a clock-wise direction in order to disengage the fixation means 40 from the part of the L-shaped groove running parallel with the longitudinal axis A (the fixation protrusion 41 then runs in the part of the L-shaped groove running transverse with the longitudinal axis A). Hence the first member 10 may safely be disconnected from the first container 2 without exposure of the piercing member. The arrangement provides for a quick and secure fluid transfer between two containers.

As described earlier a piercing member may either be arranged on the first member 30, or it may be attached to the second container 3 in order to establish a fluid communication between the first and the second container 2, 3. In either case the first member 10 is preferably provided with stabilization means 50 (see in FIG. 7) in order to stabilize the piercing member in to create maximum stability for the piercing member during movement of the first member 10 from its secured position to its unsecured position. The stabilization means 50 is preferably constituted by a hollow tube in which at least a part of a piercing member can be arranged. The stabilization means 50 preferably stretches from the second end 13 of the first member 10 to the proximity of the first end 31 of the first member 30 when the piercing member protection device 1 is in its unsecured state.

As described in FIG. 1-5 the second member 20 partly encompasses the third member 30. In an alternative embodiment of the present invention the third member 30 may encompass the second member 20. Features are then adapted in order to reach the same function concerning safety, speed and simplicity to use as described with the embodiments above.

Figure 6:
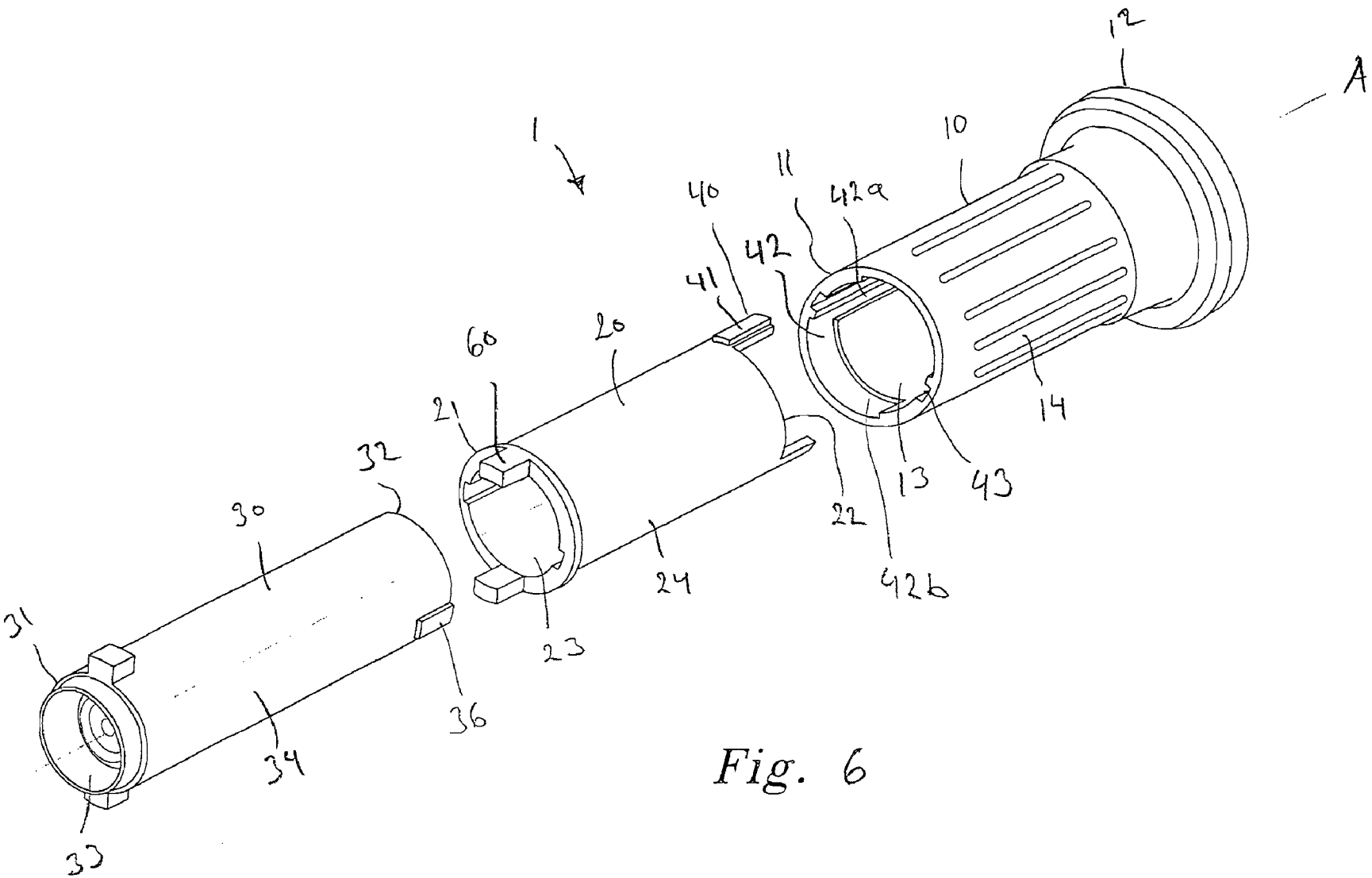
FIG. 6 is a schematic illustration of the piercing member protection device in an exploded view.

FIG. 6 illustrates an exploded view of the elements forming a piercing member protection device 1 according to one embodiment of the present invention. More specifically FIG. 6 shows a first member 10, a second member 20 and a third member 30. The first member 10 has a first end 11 and a second end 12 and an inner and an outer surface 13, 14. A second member 20 comprising a first end 21 opposite a second end 22 and an inner and an outer surface 23, 24. A third member 30 comprising a first end 31 opposite a second end 32 and an inner and an outer surface 33, 34.

A fixation protrusion 41 and a substantially L-shaped groove 42 are arranged on the first and said second member 10, 20. The fixation protrusion 41 preferably protrudes out from the plane of the outer surface of the second member, while the L-shaped groove is preferably arranged on the inner surface of the first member 10. The main object of the fixation protrusion 41 is to prevent the first member 10 from turning with respect to the second member 20 after the fixation protrusion 41 has entered that part of the L-shaped groove running parallel with the longitudinal axis A, while at the same time allow the first member 10 to slide along the longitudinal axis A (as earlier illustrated in FIG. 1).

As can be seen in FIG. 6 the L-shaped groove 42 has a longitudinal and a transverse 42*a*, 42*b* extension with respect to the longitudinal axis A. The transverse extension 42*b* of the L-shaped groove 42 allows for the second member 20 to turn with respect to the first member 10 between a locked position and an unlocked position. The first member 10 is in the locked position for as long as the fixation protrusion 41 on the second member 20 is in the transverse part 42*b* of the L-shaped groove 42. During this locked position the first member 10 is effectively disabled from movement along the longitudinal axis A with respect to the second member 20, i.e. from moving to the unsecured position. In the illustrated embodiment of the present invention in FIG. 6 the first member 10 is effectively prevented from disengagement from the second member 20 by means of a small flange, stretching inwards towards the centre of the first member 10 (not shown) which can be arranged along first end 11 of the first member 10 and the transverse part 42*b* of the L-shaped groove 42. Or in other embodiment the position of the L-shaped groove 42 can be arranged further away from the first end 11 of the first member 10. As long as the first member can be relatively easy to assemble there are no restrictions concerning the actual position (with respect to the longitudinal axis A) of the L-shaped groove.

Engagement means 60 is arranged on the first end 21 of the second member 20 in order to engage a first container in order to prevent the second member 20 from turning after connection. The engagement means 60 are in the form of a longitudinal protrusion extending in the direction of the longitudinal axis A which engages the first container in a corresponding groove on the first container. Hence when the engagement means 60 and the fixation means 40, in the shown embodiment, the fixation protrusion 41 and the L-shaped groove 42 interact, the first member 10 is disabled from turning when the first member 10 is in its unsecured position.

Figure 7:
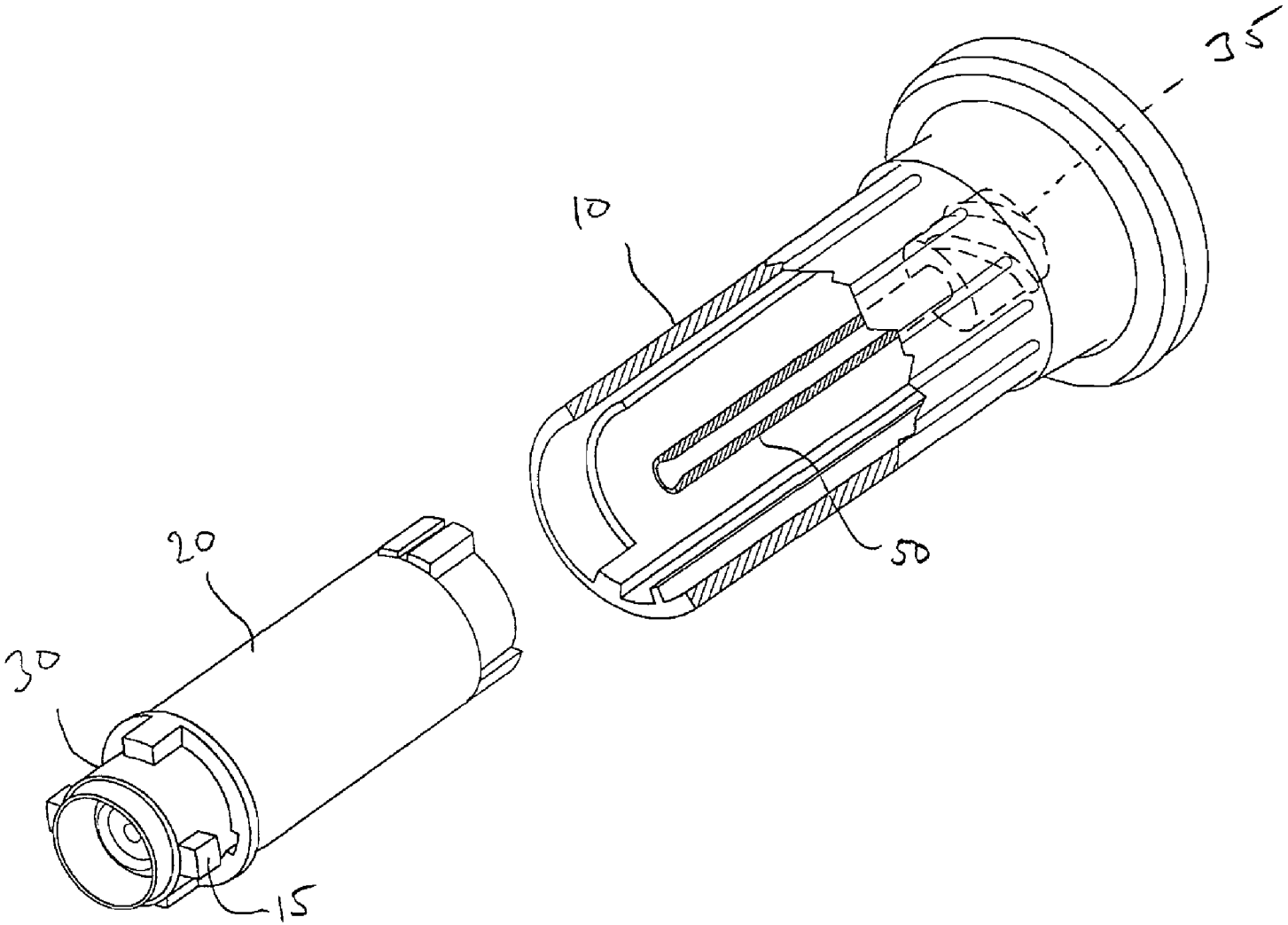
FIG. 7 is a schematic illustration of the piercing member protection device as see in an partly exploded view.

The third member 30 further comprises an end protrusion 36 protruding out from the plane of said outer surface 34 of the third member 30 at the second end 32 of said third member 30. The end protrusion 36 is arranged to be in working cooperation with a separate longitudinal groove 43 arranged on the inner surface 13 of the first member 10. The end protrusion 36 and the longitudinal groove 43 prevents the first member 10 and the third member 30 from turning with respect to each other while allowing for longitudinal movement along the longitudinal axis A with respect to each other. In FIG. 7 the second and third members 20, 30 are illustrated after assembly in combination with the first member 10 (just before assembly). The first member 10 further comprises connection means 35 which comprises of a threaded coupling onto which e.g. a syringe or similar may be screwed in order to provide a second fluid container. Stabilization means 50 preferably constituted by a hollow tube in which at least a part of a piercing member can arranged wither as a fixed part of the first member 10 or as a connectable part via the second container such as a syringe.

An example of a suitable connection means on a first container 2 (as seen in FIG. 1) is illustrated in US 2003/0070726 A1 such connection means constitute a fluid container connector comprising a sleeve member with an guiding groove in which the connection means 15 of the third member 30 may be inserted. Further can the engagement means 60 be arranged to engage such guiding groove. Any piercing member arranged to or in the piercing member protection device 1 is thereby effectively protected form exposure since the first member 10 must first be retracted back to its secured position before the first member can be turned to disengage the first container via the connection means 15 of the third member. However the engagement means 60 may be formed to engage any fluid container so that the second member 20 is effectively prevented from turning after connection and thereby achieve the same function as described above.

The present invention also comprises a kit of a first container, a second container and a piercing member protection device 1 as described earlier (including all combinations) as well as a method for transferring fluid between a first container and a second container using a piercing member protection device as described earlier (including all combinations).

The invention claimed is:

1. A piercing member protection device comprising a longitudinal axis, wherein said piercing member protection device comprises a protection chamber to protect at least the tip of a piercing member, said piercing member protection device further comprises a first and a second member arranged to each other, said first member having a first and a second end and an inner and outer surface, and said second member having a first and a second end and an inner and outer surface, wherein said first member is arranged to slide with respect to said second member between a secured position, in which at least the tip of said piercing member is enclosed within the protection chamber so as to prevent said tip of said piercing member from exposure, and an unsecured position, in which said tip of said piercing member is arranged outside said protection chamber, wherein said first member is arranged to turn with respect to said second member between a locked position and an unlocked position so that when said first member is in said locked position said first member is substantially unable to slide along said longitudinal axis and when said first member is in said unlocked position said first member is enabled to slide along said longitudinal axis, wherein said piercing member protection device further comprises a third member arranged to said second member, said third member having a first and a second end and an inner and outer surface, wherein said first end of said third member comprises connection means for connecting to a first fluid container, and wherein the first and second end of said second member are arranged longitudinally inwards of said first and second end of said third member.

2. The piercing member protection device according to claim 1, wherein said second member is arranged to at least partly encompass said outer surface of said third member.

3. The piercing member protection device according to claim 1, wherein said first member is provided with a piercing member arranged along said longitudinal axis.

4. The piercing member protection device according to claim 1, wherein said first member is arranged with stabilization means in order to stabilise a piercing member.

5. The piercing member protection device according to claim 1, wherein said third member is adapted to be turned with respect to said second member by means of said first member.

6. The piercing member protection device according to claim 5 wherein said third member is adapted to be turned with respect to said second member by means of said first member by means of a protrusion and a groove.

7. The piercing member protection device according to claim 6 wherein said means of a protrusion and a groove comprises an end protrusion protruding out from the plane of said outer surface of said third member at said second end of said third member, and that said end protrusion is arranged to be in working cooperation with a longitudinal groove arranged on the inner surface of said first member.

8. The piercing member protection device according to claim 1, wherein said locked position and an unlocked position are obtained by means of a fixation protrusion arranged on said second member and a substantially L-shaped groove arranged on the first member.

9. The piercing member protection device according to claim 8 wherein said fixation protrusion protrudes out from the plane of said outer surface of said second member, and that said L-shaped groove is arranged on the inner surface of said first member, said L-shaped groove having a longitudinal extension along the longitudinal axis and transverse extension transverse to said longitudinal axis.

10. The piercing member protection device according to claim 1, wherein said first end of said second member comprises engagement means wherein said engagement means is arranged to engage with said first fluid container so as to prevent said second member from turning in a clock-wise or anti-clock wise direction.

11. The piercing member protection device according to claim 10 wherein said engagement means comprises an engagement protrusion arranged at said first end of said second member and that said engagement protrusion extends along said longitudinal axis.

12. The piercing member protection device according to claim 10 wherein said engagement means comprises an engagement protrusion arranged at said first end of said second member and that said engagement protrusion extends out of the plane of the outer surface of said second member.

13. The piercing member protection device according to claim 1, wherein said second member comprises a flange arranged in the proximity of said first end of said second member, said flange extending from the inner surface of said second member in a direction towards the centre of the second member, said flange being arranged to engage a groove arranged on said outer surface of said third member wherein said flange and said groove are arranged transverse to said longitudinal axis so that said second and third member are substantially fixed from movement along said longitudinal axis with respect to each other.

14. The piercing member protection device according to claim 1, wherein said second member comprises a flange extending from the outer surface of said second member in a direction away from the centre of said second member, said flange being arranged in the proximity of said first end of said second member, wherein said flange acts as stopping means to stop said first member from sliding beyond said flange.

15. The piercing member protection device according to claim 1, wherein said piercing member protection device is a medical piercing member protection device.

16. The piercing member protection device according to claim 1, wherein said first member is a cylinder member.

17. The piercing member protection device according to claim 1, wherein said second member is a cylinder member.

18. The piercing member protection device according to claim 1, wherein said third member is a cylinder member.

19. A kit comprising a first fluid container, a second fluid container and a piercing member protection device to protect a piercing member used for transferring fluid between said first fluid container and said second fluid container, wherein said piercing member protection device comprises a longitudinal axis, wherein said piercing member protection device comprises a protection chamber to protect at least the tip of a piercing member, said piercing member protection device further comprises a first and a second member arranged to each other, said first member having a first and a second end and an inner and outer surface, and said second member having a first and a second end and an inner and outer surface, wherein said first member is arranged to slide with respect to said second member between a secured position, in which at least the tip of said piercing member is enclosed within the protection chamber so as to prevent said tip of said piercing member from exposure, and an unsecured position, in which said tip of said piercing member is arranged outside said protection chamber, wherein said first member is arranged to turn with respect to said second member between a locked position and an unlocked position so that when said first member is in said locked position said first member is substantially unable to slide along said longitudinal axis and when said first member is in said unlocked position said first member is enabled to slide along said longitudinal axis, wherein said piercing member protection device further comprises a third member arranged to said second member, said third member having a first and a second end and an inner and outer surface, wherein said first end of said third member comprises connection means for connecting to a first fluid container, and wherein the first and second end of said second member are arranged longitudinally inwards of said first and second end of said third member.

20. A method for transferring fluid between a first fluid container and a second fluid container using a piercing member protection device to protect a piercing member used for transferring fluid between said first fluid container and said second fluid container, wherein said piercing member protection device comprises a longitudinal axis, wherein said piercing member protection device comprises a protection chamber to protect at least the tip of a piercing member, said piercing member protection device further comprises a first and a second member arranged to each other, said first member having a first and a second end and an inner and outer surface, and said second member having a first and a second end and an inner and outer surface, wherein said first member is arranged to slide with respect to said second member between a secured position, in which at least the tip of said piercing member is enclosed within the protection chamber so as to prevent said tip of said piercing member from exposure, and an unsecured position, in which said tip of said piercing member is arranged outside said protection chamber, wherein said first member is arranged to turn with respect to said second member between a locked position and an unlocked position so that when said first member is in said locked position said first member is substantially unable to slide along said longitudinal axis and when said first member is in said unlocked position said first member is enabled to slide along said longitudinal axis, wherein said piercing member protection device further comprises a third member arranged to said second member, said third member having a first and a second end and an inner and outer surface, wherein said first end of said third member comprises connection means for connecting to said first fluid container, and wherein the first and second end of said second member are arranged longitudinally inwards of said first and second end of said third member, wherein the method comprises:

connecting said first fluid container and said second fluid container to the piercing member protection device;

turning said first member with respect to said second member from a locked position to an unlocked position, wherein when said second member is in said locked position said first member is substantially unable to slide along the longitudinal axis and when said second member is in the unlocked position said first member is able to slide along said longitudinal axis; and moving said first member along said longitudinal axis to the unsecured position and thereby exposing said piercing member outside said protection chamber so that fluid communication between said first fluid container and said second fluid container is provided.

* * * * *